US009313573B2

(12) United States Patent
Schüldt et al.

(10) Patent No.: US 9,313,573 B2
(45) Date of Patent: Apr. 12, 2016

(54) METHOD AND DEVICE FOR MICROPHONE SELECTION

(75) Inventors: Christian Schüldt, Stockholm (SE); Fredric Lindström, Umeå (SE)

(73) Assignee: Limes Audio AB (SE)

( * ) Notice: Subject to any disclaimer, the term of this patent is extended or adjusted under 35 U.S.C. 154(b) by 325 days.

(21) Appl. No.: 13/980,517

(22) PCT Filed: Nov. 16, 2011

(86) PCT No.: PCT/SE2011/051376

§ 371 (c)(1),
(2), (4) Date: Aug. 21, 2013

(87) PCT Pub. No.: WO2012/099518

PCT Pub. Date: Jul. 26, 2012

(65) Prior Publication Data

US 2013/0322655 A1 Dec. 5, 2013

(30) Foreign Application Priority Data

Jan. 19, 2011 (SE) ..... 1150031

(51) Int. Cl.
*H04R 3/00* (2006.01)
*G10L 21/02* (2013.01)
(Continued)

(52) U.S. Cl.
CPC ..... *H04R 3/005* (2013.01); *G10L 21/02* (2013.01); *G10L 21/0264* (2013.01); *G10L 25/12* (2013.01); *G10L 2021/02166* (2013.01); *H04R 2430/03* (2013.01)

(58) Field of Classification Search
None
See application file for complete search history.

(56) References Cited

U.S. PATENT DOCUMENTS 4,449,238 A 5/1984 Lee
5,353,374 A * 10/1994 Wilson et al. ..... 704/226
(Continued)

FOREIGN PATENT DOCUMENTS

EP 1081682 A2 3/2001
EP 2214420 A1 8/2010
WO WO-2006078003 A2 7/2006

OTHER PUBLICATIONS

"International Application Serial No. PCT/SE2011/051376, International Preliminary Report on Patentability dated Jul. 23, 2013", 8 pgs.
(Continued)

*Primary Examiner* — Paul Huber
(74) *Attorney, Agent, or Firm* — Schwegman, Lundberg & Woessner, P.A.

(57) ABSTRACT

The present invention relates to a device, such as an audio communication device, for combining a plurality of microphone signals $x_n(k)$ into a single output signal y(k). The device comprises processing means configured to calculate control signals $f_n(k)$, and control means configured to select which microphone signal $x_n(k)$ or which combination of microphone signals $x_n(k)$ to use as output signal y(k) based on said control signals $f_n(k)$. To improve the selection, the device comprises linear prediction filters for calculating linear prediction residual signals $e_n(k)$ from the plurality of microphone signals $x_n(k)$, and the processing means is configured to calculate the control signals $f_n(k)$ based on said linear prediction residual signals $e_n(k)$.

21 Claims, 3 Drawing Sheets

(51) Int. Cl.

| | |
|---|---|
| *G10L 21/0264* | (2013.01) |
| *G10L 25/12* | (2013.01) |
| *G10L 21/0216* | (2013.01) |

(56) References Cited

U.S. PATENT DOCUMENTS

| | | | | |
|---|---|---|---|---|
| 5,625,697 | A | 4/1997 | Bowen et al. | |
| 5,787,183 | A | 7/1998 | Chu et al. | |
| 6,317,501 | B1 | 11/2001 | Matsuo | |
| 7,046,812 | B1 * | 5/2006 | Kochanski et al. | 381/92 |
| 2003/0138119 | A1 | 7/2003 | Pocino et al. | |
| 2011/0066427 | A1 | 3/2011 | Konchitsky et al. | |

OTHER PUBLICATIONS

"International Application Serial No. PCT/SE2011/051376, International Search Report mailed Apr. 20, 2012", 5 pgs.

"International Application Serial No. PCT/SE2011/051376, Written Opinion mailed Apr. 20, 2012", 7 pgs.

Kokkinakis, K., et al., "Blind Separation of Acoustic Mixtures Based on Linear Prediction Analysis", *4th International Symposium on Independent Component Analysis and Blind Signal Separation* (*ICA* 2003), (2003), 343-348.

* cited by examiner

METHOD AND DEVICE FOR MICROPHONE SELECTION

RELATED APPLICATIONS

This application is a US National Stage application filed under 35 U.S.C. §371 from International Application Serial No. PCT/SE2011/051376, filed Nov. 16, 2011 and published as WO 2012/099518 A1 on Jul. 26, 2012, which claims the priority benefit of Sweden Patent Application No. 1150031-1, filed on Jan. 19, 2011, the contents of which applications and publication are incorporated herein by reference in their entirety.

TECHNICAL FIELD

The present invention relates to a device according to the preamble of claim 1, a method for combining a plurality of microphone signals into a single output signal according to the preamble of claim 11, and a computer-readable medium according to the preamble of claim 21.

BACKGROUND OF THE INVENTION

The invention concerns a technological solution targeted for systems including audio communication and/or recording functionality, such as, but not limited to, video conference systems, conference phones, speakerphones, infotainment systems, and audio recording devices, for controlling the combination of two or more microphone signals into a single output signal.

The main problems in this type of setup is microphones picking up (in addition to the speech) background noise and reverberation, reducing the audio quality in terms of both speech intelligibility and listener comfort. Reverberation consists of multiple reflected sound waves with different delays. Background noise sources could be e.g. computer fans or ventilation. Further, the signal-to-noise ratio (SNR), i.e. ratio between the speech and noise (background noise and reverberation), is likely to be different for each microphone as the microphones are likely to be at different locations, e.g. within a conference room. The invention is intended to adaptively combine the microphone signals in such a way that the perceived audio quality is improved.

To reduce background noise and reverberation in setups with multiple microphones, beamforming-based approaches have been suggested; see e.g. M. Brandstein and D. Ward, *Microphone Arrays: Signal Processing Techniques and Applications*. Springer, 2001. However, as beamforming is non-trivial in practice and generally requires significant computational complexity and/or specific spatial microphone configurations, microphone combining (or switching/selection) has been used extensively in practice, see e.g. P. Chu and W. Barton, "Microphone system for teleconferencing system," U.S. Pat. No. 5,787,183, Jul. 28, 1998, D. Bowen and J. G. Ciurpita, "Microphone selection process for use in a multiple microphone voice actuated switching system," U.S. Pat. No. 5,625,697, Apr. 29, 1997 and B. Lee and J. J. F. Lynch, "Voice-actuated switching system," U.S. Pat. No. 4,449,238, May 15, 1984. In the microphone selection/combining approach, the idea is to use the signal from the microphone(s) which is located closest to the current speaker, i.e. the microphone(s) signal with the highest signal-to-noise ratio (SNR), at each time instant as output from the device.

Known microphone selection/combination methods are based on measuring the microphone energy and selecting the microphone which has largest input energy at each time instant, or the microphone which experiences a significant increase in energy first. The drawback of this approach is that in highly reverberative or noisy environments, the interference of the reverberation or noise can cause a non optimal microphone to be selected, resulting in degradation of audio quality. There is thus a need for alternative solutions for controlling the microphone selection/combination.

SUMMARY OF THE INVENTION

It is an object of the present invention to provide means for improved selection/combination of multiple microphone input signals into a single output signal.

This object is achieved by a device for combining a plurality of microphone signals into a single output signal. The device comprises processing means configured to calculate control signals, and control means configured to select which microphone signal or which combination of microphone signals to use as output signal based on said control signals. The device further comprises linear prediction filters for calculating linear prediction residual signals from said plurality of microphone signals, and the processing means is configured to calculate the control signals based on said linear prediction residual signals.

By selecting which microphone signal or which combination of microphone signals to use as output signal based on control signals that are calculated based on linear prediction residual signals instead of the microphone signals, several advantages are achieved. Owing to the de-correlation (whitening) property of linear prediction filters, some amount of reverberation is removed from the microphone signals, as well as correlated background noise. Both reverberation and background noise influences the microphone selection control negatively. Thus, by lessening the amount of reverberation and correlated background noise the microphone selection performance is improved.

Preferably, the control signals are calculated based on the energy content of the linear prediction residual signals. The processing unit may be configured to compare the output energy from adaptive linear prediction filters and, at each time instant, select the microphone(s) associated with the linear prediction filter(s) that produces the largest output energy/energies. This improves the audio quality by lessening the risk of selecting non-optimal microphone(s).

In a preferred embodiment, the device comprises means for delaying the plurality of microphone signals, filtering the delayed microphone signals, and generating the linear prediction residual signals from which the control signals are calculated by subtracting the original microphone signals from the delayed and filtered signals.

Preferably, the device further comprises means for generating intermediate signals by rectifying and filtering the linear prediction residual signals obtained as described above. These intermediate signals may, together with said plurality of microphone signals, be used as input signals by a processing means of the device to calculate the control signals.

In other embodiments the said processing means may be configured to calculate the control signals based on any of, or any combination of the linear prediction residual signals, said intermediate signals, and one or more estimation signals, such as noise or energy estimation signals, which in turn may be calculated based on the plurality of microphone signals.

According to a preferred embodiment, the control means for selecting which microphone signal or which combination of microphone signals that should be used as output signal is configured to calculate a set of amplification signals based on the control signals, and to calculate the output signal as the sum of the products of the amplification signals and the corresponding microphone signals.

Other advantageous features of the device will be described in the detailed description following hereinafter.

The object is also achieved by a method for combining a plurality of microphone signals into a single output signal, comprising the steps of:

calculating linear prediction residual signals from said plurality of microphone signals;

calculating control signals based on said linear prediction residual signals, and selecting, based on said control signals, which microphone signal or which combination of microphone signals to use as output signal.

Also provided is a computer program capable of causing the previously described device to perform the above method.

It should be appreciated that, at least in this document, "combining" a plurality of entities into a single entity includes the possibility of selecting one of the plurality of entities as said single entity. Thus, it should be appreciated that "combining a plurality of microphone signals into a single output signal" herein includes the possibility of selecting a single one of the microphone signals as output signal.

BRIEF DESCRIPTION OF THE DRAWINGS

A more complete appreciation of the invention disclosed herein will be obtained as the same becomes better understood by reference to the following detailed description when considered in conjunction with the accompanying figures briefly described below.

DETAILED DESCRIPTION OF THE INVENTION

In the following, for the case of clarity, the invention and the advantages thereof will be described mainly in the context of a preferred embodiment scenario. However, the skilled person will appreciate other scenarios of combinations which can be achieved using the same principles.

Figure 1:
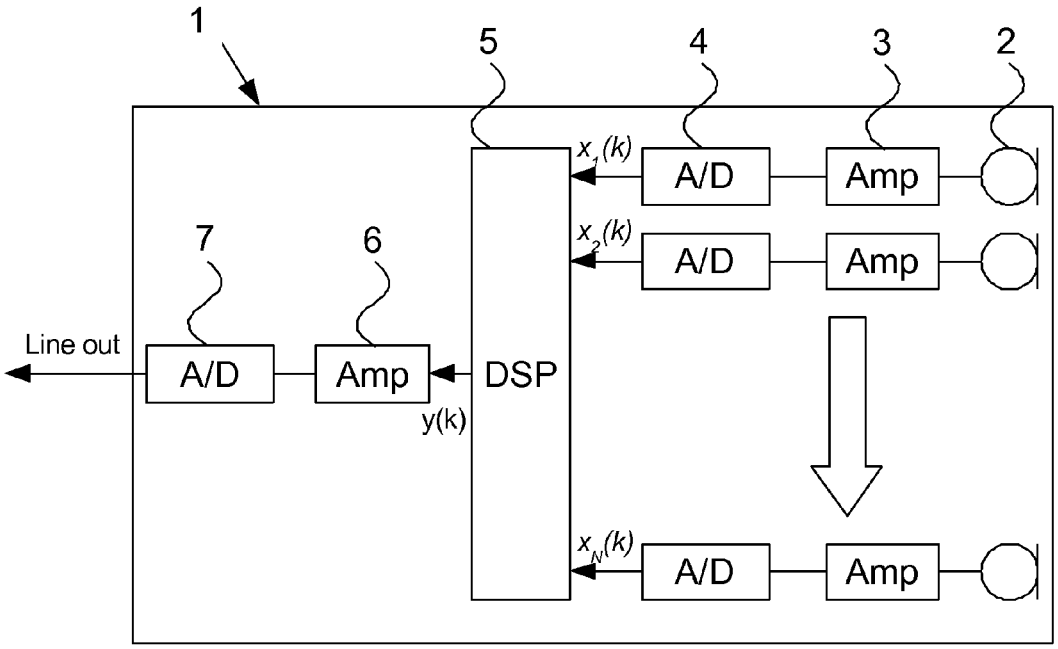
FIG. 1 is a schematic block diagram illustrating a plurality of microphone signals fed to a digital signal processor (DSP)

FIG. 1 illustrates a block diagram of an exemplary device 1, such as an audio communication device, comprising a number of N microphones 2. Local (reverberated) speech and noise is picked up by the microphones 2, amplified by an amplifier 3, converted to discrete signals $x_n(k)$ (where n=1, 2, . . . , N) by an analog-to-digital converter 4, and fed to a digital signal processor (DSP) 5. The DSP 5 produces a digital output signal y(k), which is amplified by an amplifier 6 and converted to an analog line out signal by a digital-to-analog converter 7.

Figure 2:
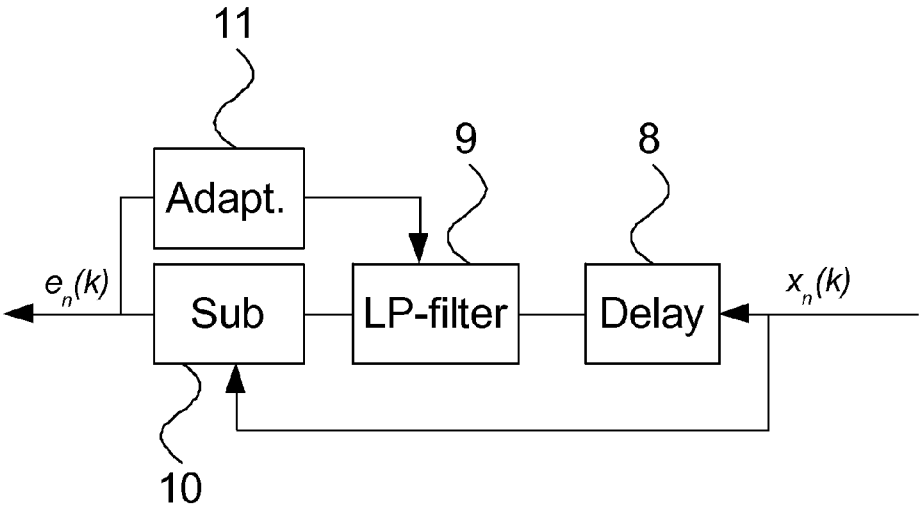
FIG. 2 illustrates a linear prediction process according to a preferred embodiment of the invention.

FIG. 2 shows a linear prediction process for the preferred embodiment of the invention illustrated for one microphone signal $x_n(k)$ performed in the DSP 5. Preferably, the linear prediction process for all microphone signals (n=1, 2, . . . , N) are identical. First, the microphone signal $x_n(k)$ is delayed for one or more sample periods by a delay processing unit 8, e.g. by one sample period, which in an embodiment with 16 kHz sampling frequency corresponds to a time period of 62.5 μs. The delayed signal is then filtered with an adaptive linear prediction filter 9 and the output is subtracted from the microphone signal $x_n(k)$, by a subtraction unit 10, resulting in a linear prediction residual signal $e_n(k)$. The linear prediction residual signal is used to update the adaptive linear prediction filter 9. The algorithm for adapting the linear prediction filter 9 could be least mean square (LMS), normalized least mean square (NLMS), affine projection (AP), least squares (LS), recursive least squares (RLS) or any other type of adaptive filtering algorithm. The updating of the linear prediction filter 9 may be effectuated by means of a filter adaption unit 11.

Figure 3:
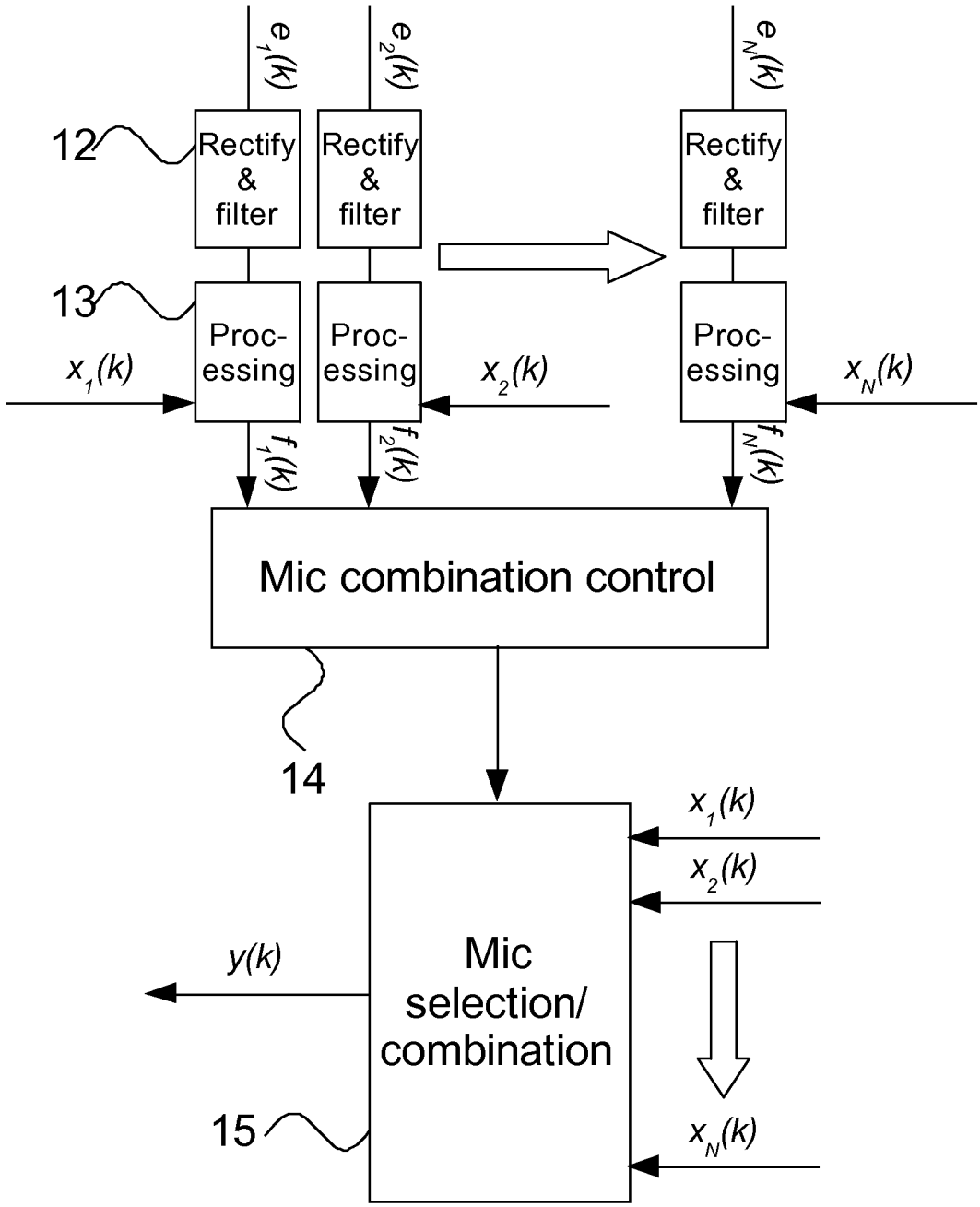
FIG. 3 is a block diagram of a microphone selection process according to a preferred embodiment of the invention.

FIG. 3 shows a block diagram illustrating the microphone selection/combination process performed by the DSP 5 after having performed the linear prediction process illustrated in FIG. 2. In the preferred embodiment of the invention the output signals $e_n(k)$ from the adaptive linear prediction filters 9 are rectified and filtered by a linear prediction residual filtering unit 12 producing intermediate signals. These intermediate signals are then processed by processing means 13, hereinafter sometimes referred to as the linear prediction residual processing unit, using the microphone signals as input signals. In the preferred embodiment of the invention the linear prediction residual processing unit estimates the level of stationary noise of the microphone signals and use this information to remove the noise components in the intermediate signal to form the control signals $f_n(k)$. The processing of the processing means 13 helps to avoid situations of erroneous behaviour where e.g. one microphone is located close to a noise source.

The control signals $f_n(k)$ are used by a microphone combination controlling unit (14) to control the selection of the microphone signal or the combination of microphone signals that should be used as output signal y(k). The selection is performed in a microphone combination unit 15.

In the preferred embodiment of the invention the microphone combination controlling unit 14 processes the control signals $f_n(k)$ in order to produce amplification signals $c_n(k)$. These amplification signals $c_n(k)$ are then used to combine the different microphone signals $x_n(k)$ by multiplying each amplification signal with its corresponding microphone signal and summing all these products in order to produce the output signal. For example $[c_1(k), c_2(k), c_3(k), \ldots, c_N(k)] = [1,0,0, \ldots, 0]$, implies that the output signal is identical to the first microphone signal.

The microphone combination controlling unit 14 and the microphone combination unit 15 hence together form control means for selecting which microphone signal $x_n(k)$ or which combination of microphone signals $x_n(k)$ should be used as output signal y(k), based on the control signals $f_n(k)$ received from the processing means 13.

In one embodiment of the invention the microphone combination controlling unit (14) process is performed according to:

$$[c_1(k), c_2(k), c_3(k), \ldots, c_N(k)] = [0, 0, 0, \ldots, 0]$$
$$f_{max}(k) = \max\{f_1(k), f_2(k), \ldots, f_N(k)\}$$
$$f_{mean}(k) = \text{mean}\{f_1(k), f_2(k), \ldots, f_N(k)\}$$
$$i = \text{argmax}\{f_1(k), f_2(k), \ldots, f_N(k)\}$$
$$\text{if } (f_{max}(k) - f_{a(k-1)}(k))/f_{mean}(k) > T \quad \text{then } a(k) = i, \quad \text{else } a(k) = a(k-1), \; c_{a(k)}(k) = 1,$$

where T is a threshold and a(k) is the index of the currently selected microphone.

In some situations it may be advantageous to allow previous values of the control signals $c_n(k)$ to influence the current value. For example, two speakers might be active simultaneously. In one embodiment of the invention a switching between two microphones is avoided by setting both microphones as active should such a situation occur. I another embodiment of the invention, quick fading in of the new selected microphone signal and quick fading out of the old selected microphone signal is used to avoid audible artifacts such as clicks and pops.

The signal processing performed by the elements denoted by reference numerals 9 to 15 may be performed on a sub-band basis, meaning that some or all calculations can be performed for one or several sub-frequency bands of the processed signals. The control of the microphone selection/combination may be based on the results of the calculations performed for one or several sub-bands and the combination of the microphone signals can be done in a sub-band manner. In a preferred embodiment of the invention the calculations performed by the elements 9 to 14 is performed only in high frequency bands. Since sound signals are more directive for high frequencies, this increases sensitivity and also reduces computational complexity, i.e. reducing the computational resources required.

Figure 4:
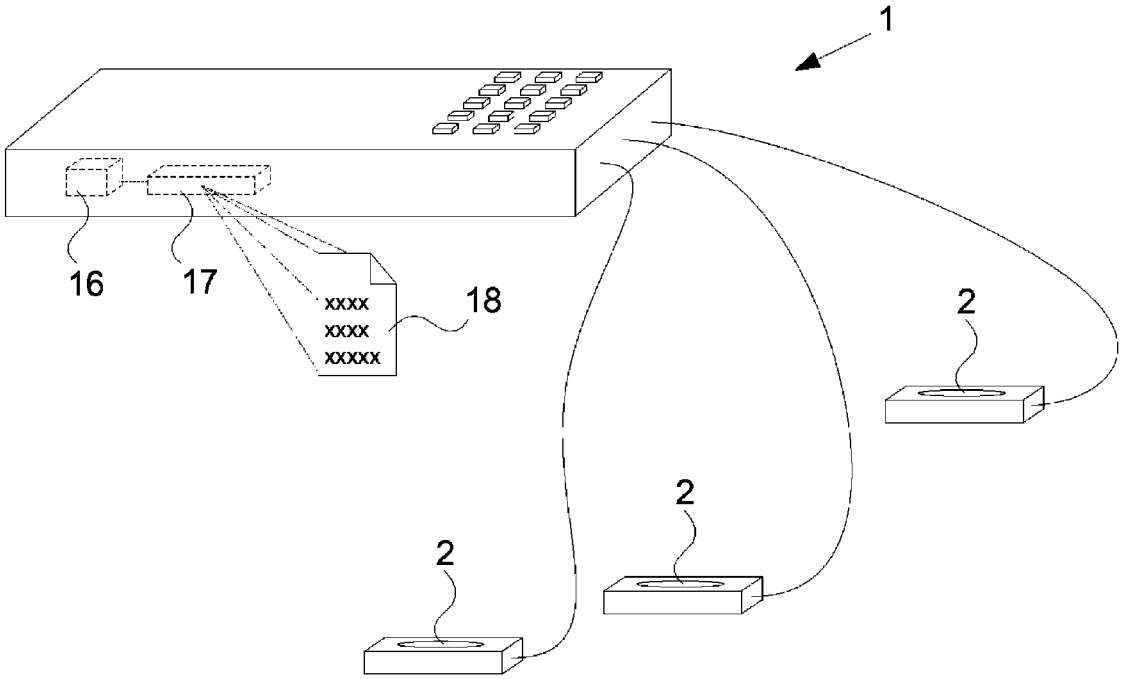
FIG. 4 illustrates an exemplary device comprising a computer program according to the invention.

FIG. 4 illustrates an exemplary device 1 according to the invention comprising several microphones 2. The device further comprises a processing unit 16 which may or may not be the DSP 5 in FIG. 1, and a computer readable medium 17 for storing digital information, such as a hard disk or other non-volatile memory. The computer readable medium 17 is seen to store a computer program 18 comprising computer readable code which, when executed by the processing unit 16, causes the DSP 5 to select/combine any of the microphones 2 for output signal y(k) according to principles described herein.

The invention claimed is:

1. A device for combining a plurality of microphone signals $x_n(k)$ into a single output signal y(k), comprising:

processing means configured to calculate control signals $f_n(k)$;

control means configured to select which microphone signal $x_n(k)$ or which combination of microphone signals $x_n(k)$ to use as output signal y(k) based on said control signals $f_n(k)$, characterised in that said device comprises linear prediction filters for calculating linear prediction residual signals $e_n(k)$ from said plurality of microphone signals $x_n(k)$, and in that said processing means is configured to calculate said control signals $f_n(k)$ based on said linear prediction residual signals $e_n(k)$.

2. The device according to claim 1, further comprising delay processing means and a subtraction unit, wherein the delay processing means is configured to delay said plurality of microphone signals $x_n(k)$, the linear prediction filters are configured to filter the delayed microphone signals, and the subtraction unit is configured to subtract said microphone signals $x_n(k)$ from the delayed and filtered signals in order to obtain said linear prediction residual signals $e_n(k)$.

3. The device according to claim 1, further comprising linear prediction residual filtering means configured to generate intermediate signals by rectifying and filtering said linear prediction residual signals $e_n(k)$.

4. The device according to claim 3, wherein the processing means is configured to calculate said control signals $f_n(k)$ using said intermediate signals and said plurality of microphone signals $x_n(k)$ as input signals.

5. The device according to claim 3, wherein said processing means is configured to calculate said control signals $f_n(k)$ based on any of, or any combination of:

said linear prediction residual signals $e_n(k)$, said intermediate signals, and estimation signals, such as noise or energy estimation, which in turn is calculated based on said plurality of microphone signals $x_n(k)$.

6. The device according to claim 1, wherein said control means comprises microphone combining control means configured to calculate a set of amplification signals $c_n(k)$ based on said control signals $f_n(k)$.

7. The device according to claim 6, wherein said control means further comprises microphone combination means configured to calculate the output signal y(k) as the sum of the products of said amplification signals $c_n(k)$ and the corresponding microphone signals $x_n(k)$.

8. The device according to claim 6 wherein the said microphone combining controlling means is configured to calculate said amplification signals $c_n(k)$ based on a comparison between one or a set of thresholds and combinations of some or all of said control signals $f_n(k)$.

9. The device according to claim 8 wherein said thresholds are calculated based on previous calculations of said amplification signals $c_n(k)$.

10. The device according to claim 1, wherein said device is configured to perform all or some of the calculations for given sub-frequency bands of the processed signals so that the combination of the microphone signals $x_n(k)$ may be performed in sub-bands or in full band, based on some or all of the frequency bands used.

11. A method for combining a plurality of microphone signals $x_n(k)$ into a single output signal y(k), comprising the steps of:

calculating control signals $f_n(k)$;

selecting, based on said control signals $f_n(k)$, which microphone signal $x_n(k)$ or which combination of microphone signals $x_n(k)$ to use as output signal y(k), characterised by the steps of:

calculating linear prediction residual signals $e_n(k)$ from said plurality of microphone signals $x_n(k)$, and calculating said control signals $f_n(k)$ based on said linear prediction residual signals $e_n(k)$.

12. The method according to claim 11 wherein the step of calculating said linear prediction residual signals $e_n(k)$ is performed by delaying said microphone signals $x_n(k)$, filtering the delayed microphone signals, and subtracting the microphone signals $x_n(k)$ from the delayed and filtered signals in order to obtain the said linear prediction residual signals $e_n(k)$.

13. The method according to claim 11, further comprising the step of generating intermediate signals by rectifying and filtering said linear prediction residual signals $e_n(k)$.

14. The method according to claim 13, wherein said control signals $f_n(k)$ are calculated using said intermediate signals and said plurality of microphone signals $x_n(k)$ as input signals.

15. The method according to claim 13 wherein said control signals $f_n(k)$ are calculated based on any of, or any combination of:

said linear prediction residual signals $e_n(k)$, said intermediate signals, and estimation signals, such as noise or energy estimation, which in turn is calculated based on said plurality of microphone signals $x_n(k)$.

16. The method according to claim 11, further comprising the step of calculating a set of amplification signals $c_n(k)$ based on said control signals $f_n(k)$.

17. The method according to claim 16, wherein the step of calculating the output signal y(k) is performed by calculating the sum of the products of said amplification signals $c_n(k)$ and the corresponding microphone signals $x_n(k)$.

18. The method according to claim 16, wherein said amplification signals $c_n(k)$ are calculated by comparing combinations of some or all of the said control signals $f_n(k)$ to one or a set of thresholds.

19. The method according to claim 18 wherein the said thresholds are calculated based on previous calculations of said amplification signals $c_n(k)$.

20. The method according to claim 11, wherein all or some calculations are made for given sub-frequency bands of the processed signals so that the combination of the microphone signals $x_n(k)$ may be performed in sub-bands or full-band, based on some or all of the frequency bands used.

21. A non-transitory computer-readable medium with instructions for combining a plurality of microphone signals $x_n(k)$ into a single output signal y(k) stored thereon, which when executed by at least one processor, configure the at least one processor to perform operations comprising:

calculating control signals $f_n(k)$;

selecting, based on said control signals $f_n(k)$, which microphone signal $x_n(k)$ or which combination of microphone signals $x_n(k)$ to use as output signal y(k), characterised by the steps of:

calculating linear prediction residual signals $e_n(k)$ from said plurality of microphone signals $x_n(k)$, and calculating said control signals $f_n(k)$ based on said linear prediction residual signals $e_n(k)$.

* * * * *